US007882966B2

(12) United States Patent
Field et al.

(10) Patent No.: US 7,882,966 B2
(45) Date of Patent: Feb. 8, 2011

(54) MULTI-SHELF PAPERBOARD DISPLAY UNIT AND METHOD OF ASSEMBLING THE SAME

(75) Inventors: David L. Field, Cincinnati, OH (US); John Q. Broerman, Mainville, OH (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 422 days.

(21) Appl. No.: 11/779,723

(22) Filed: Jul. 18, 2007

(65) Prior Publication Data

US 2008/0173602 A1 Jul. 24, 2008

Related U.S. Application Data

(60) Provisional application No. 60/807,730, filed on Jul. 19, 2006.

(51) Int. Cl.
*A47G 29/00* (2006.01)

(52) U.S. Cl. ..... 211/72

(58) Field of Classification Search ..... 211/72, 211/73, 70.1, 150, 135, 195, 189, 186; 220/6.7, 220/4.28, 507, 527; 229/120.18, 120.21; 248/152, 154, 174, 300; 206/175, 176, 193, 206/362.4, 395, 784, 750, 525.1
See application file for complete search history.

(56) References Cited

U.S. PATENT DOCUMENTS 1,254,639 A * 1/1918 Lang ..... 211/72
1,951,415 A * 3/1934 Horwath ..... 248/174
1,966,676 A * 7/1934 Marsh ..... 221/311
2,104,523 A * 1/1938 Lichtenstein ..... 221/197
3,372,813 A * 3/1968 Ishida ..... 211/135
3,863,575 A * 2/1975 Kuns et al. ..... 108/179
4,311,100 A * 1/1982 Gardner et al. ..... 108/165
4,493,424 A 1/1985 Smith
4,506,790 A * 3/1985 Muscari ..... 211/59.4
4,519,319 A * 5/1985 Howlett ..... 108/180
4,530,548 A * 7/1985 Spamer et al. ..... 312/45
4,570,805 A 2/1986 Smith
4,618,115 A * 10/1986 Belokin, Jr. ..... 248/174
4,942,830 A * 7/1990 Macaluso et al. ..... 108/162
4,982,848 A 1/1991 Church et al.
5,016,545 A * 5/1991 Robertson et al. ..... 108/179
5,193,466 A * 3/1993 Eder ..... 108/166
5,322,172 A 6/1994 Maglione
5,458,411 A 10/1995 Moss
5,560,692 A * 10/1996 Smith ..... 312/114

(Continued)

*Primary Examiner*—Jennifer E. Novosad
(74) *Attorney, Agent, or Firm*—Armstrong Teasdale LLP

(57) ABSTRACT

A multi-shelf, collapsible display unit is provided. The shelving unit includes a base member including a rear panel, a pair of side panels, and a pair of front panels. Each of the pair of side panels include a fold line that extends longitudinally along each of the side panels. The shelving unit also includes at least one shelf member coupled to the base member. The shelf member includes a shelf panel, a plurality of support panels, and a locking panel. The plurality of support panels are coupled to the shelf panel and configured to support the shelf panel. The base member and the at least one shelf member are moveable between an erect position and a collapsed position. The locking panel is operably configured to removably engage at least one of the plurality of support panels to retain the shelving unit in an erect position.

15 Claims, 7 Drawing Sheets

U.S. PATENT DOCUMENTS 5,669,683 A 9/1997 Moss et al.
5,826,732 A 10/1998 Ragsdale
6,012,585 A 1/2000 Parker
6,068,140 A 5/2000 Mangrum et al.
6,098,820 A 8/2000 Smith
6,105,796 A * 8/2000 Buchanan et al. ..... 211/128.1
6,126,254 A 10/2000 Maglione
6,152,552 A * 11/2000 Snoke et al. ..... 312/257.1
6,378,710 B1 * 4/2002 Grueneberg ..... 211/132.1
6,752,280 B2 6/2004 Dye
6,783,197 B1 * 8/2004 Balogh ..... 312/259
6,966,447 B2 11/2005 Hiltke et al.
7,111,743 B1 9/2006 Moss et al.
7,185,771 B2 3/2007 Moss et al.
7,216,772 B2 5/2007 Moss et al.
7,252,200 B1 * 8/2007 Hester ..... 211/72
2003/0160015 A1 8/2003 Broerman
2004/0148825 A1 8/2004 Myers et al.
2005/0109722 A1 * 5/2005 Golias et al. ..... 211/135
2006/0151407 A1 * 7/2006 Virvo ..... 211/72
2006/0260979 A1 11/2006 Lutes et al.

* cited by examiner

MULTI-SHELF PAPERBOARD DISPLAY UNIT AND METHOD OF ASSEMBLING THE SAME

CROSS REFERENCE TO RELATED APPLICATION

This application claims priority to and the benefit of the filing date of U.S. Provisional Patent Application Ser. No. 60/807,730 filed Jul. 19, 2006.

BACKGROUND OF THE INVENTION

The present invention relates to a display unit and, more particularly, to a multi-shelf, collapsible paperboard display unit and method of assembling the same.

The merchandising industry is a very diverse industry that provides a variety of products to consumers throughout the world. For example, the merchandising industry includes stores that offer products such as food, electronics, and other consumer products. These types of stores oftentimes use a variety of display units to shelve and display the products to be sold to the consumers.

Merchandising stores also attempt to efficiently use space within the store. Accordingly, at least some known display units attempt to economize space within the store by being collapsible such that the display unit can be stored while not in use. However, at least some known display units are not capable of being collapsed into a substantially flat configuration. Accordingly, these display units do not eliminate or reduce a desired amount of space while in storage, and therefore, do not economize the space within the store.

In addition, merchants often require products to be "display ready." Accordingly, display units are often assembled by delivery drivers and/or employees who are paid according to a number of displays that can be assembled and an amount of product that can be displayed within a day. Further, it is desirable that the display units can also be disassembled quickly after use. However, at least some of these known display units are configured in such a way that both assembly and disassembly of the display unit can be difficult and/or time consuming. As such, driver and/or employee time is not reasonably economized during assembly or disassembly of such display units.

Moreover, merchants are increasingly demanding recyclable displays to eliminate the need to store displays while not in use. At least some known display units that are made at least partially from paperboard require metal, wood, and/or plastic pieces for assembly. Accordingly, these display units require additional time for assembly and are not fully recyclable.

BRIEF DESCRIPTION OF THE INVENTION

The present invention includes an economical multi-shelf display unit that is collapsible into a substantially flat configuration. Specifically, the display unit includes a base formed from a unitary blank, and a plurality of shelves, each formed from a unitary blank and secured to the base when assembled. Each shelf includes a shelf panel and a plurality of foldably coupled members that are assembled into a grid pattern of struts to support the shelf panel and attach the shelf to the base when fully assembled. The base includes a plurality of attachment locations to indicate where each shelf should be properly secured to the base. The shelves are coupled to the base in a collapsed configuration. By applying force to the sides of the base, both the base and the shelves erect into the display unit. A locking mechanism coupled to each shelf secures the grid pattern of struts and helps increase a load-bearing capacity of the shelf when merchandise is displayed thereon.

In one embodiment, a multi-shelf paperboard display unit is provided. The display unit includes a base having a rear panel, two opposed side panels, and at least two front support flaps. The two opposed side panels extend substantially perpendicularly from the rear panel, and each of the two front support flaps extend substantially perpendicularly from one of the opposed side panels such that the two front support flaps are substantially parallel to the rear panel. The display unit also includes a plurality of shelves, each formed from a unitary blank, and coupled to the base. Each shelf includes a base panel, two support members extending from opposed ends of the base panel, and a locking mechanism. Each support member includes a plurality of support panels configured to form a truss to support the base panel, wherein the truss includes a plurality of rectangular members formed from the plurality of support panels. The locking mechanism is configured to secure the truss and lock the base panel in a substantially horizontal position. The base and shelves are coupled together in a collapsed configuration such that the display unit can be manipulated between the collapsed and an erected configuration.

In another embodiment, a method of assembling a multi-shelf paperboard display unit is provided. The method includes providing a base having a rear panel, two opposed side panels, and two front support flaps. The method also includes extending the two opposed side panels substantially perpendicularly from side rear panel, and extending each of the two front support flaps substantially perpendicularly from one of the opposed side panels such that the two front support flaps are substantially parallel to the rear panel. The method also includes coupling a plurality of shelves, each formed from a unitary blank, to the base. Each shelf includes a base panel, two support members extending from opposed ends of the base panel, and a locking mechanism. The method also includes configuring the plurality of support panels to form a truss to support the base panel, wherein the truss includes a plurality of rectangular members formed from the plurality of support panels. The method also includes securing the truss with the locking mechanism to lock the base panel in a substantially horizontal position. The method also includes coupling the base and shelves together in a collapsed configuration such that the display unit can be manipulated between the collapsed and an erected configuration.

The present invention provides an economical and secure display unit for use in the merchandise industry or any other industry that may utilize a display unit. Specifically, the present invention provides a unitary shelving unit that is easily collapsed and assembled by merely folding portions of the unit. Further, the display unit provides added support and strength due the central and side struts that are easily formed from a unitary blank. Such added strength and support eliminates the need for metal, wooden and/or plastic reinforcing members that are commonly required by collapsible shelving units. As such, the display unit is fabricated entirely from paperboard and, therefore, is also easily recyclable.

In one aspect, a collapsible shelving unit made from a foldable material is provided. The shelving unit includes a base member including a rear panel, a pair of side panels, and a pair of front panels. Each of the pair of side panels extend from a side edge of the rear panel and include a fold line that extends longitudinally along each of the side panels. Each of the pair of front panels extends from a side edge of a corresponding side panel to form a portion of a face of the shelving unit. The shelving unit also includes at least one shelf member coupled to the base member. The shelf member extends in a width direction between the pair of side panels and extends in a depth direction between the rear panel and the front panels. The shelf member includes a shelf panel, a plurality of support panels, and a locking panel. The shelf panel includes a fold line extending a width of the shelf panel. The plurality of support panels are coupled to the shelf panel and configured to support the shelf panel. The base member and the at least one shelf member are moveable between an erect position and a collapsed position. The locking panel is operably configured to removably engage at least one of the plurality of support panels to retain the shelving unit in an erect position.

In a further aspect, a pair of blanks for forming a collapsible shelving unit is provided. The blanks are formed from a foldable sheet material. The pair of blanks includes a first blank for forming a base member. The first blank includes a rear panel, a pair of side panels, and a pair of front panels. Each of the pair of side panels extend from a side edge of the rear panel and include a fold line extending longitudinally along each of the side panels. Each of the pair of front panels extending from a side edge of a corresponding side panel. The pair of blanks also includes a second blank for forming a shelf member. The second blank includes a shelf panel, a plurality of support panels, and a locking panel. The shelf panel includes a fold line that extends a width of the shelf panel. The plurality of support panels are coupled to the shelf panel. At least one second blank is configured to couple to the first blank to form the collapsible shelving unit. The second blank extends in a width direction between the pair of side panels of the first blank and extends in a depth direction between the rear panel and the front panels of the first blank when the second blank is coupled to the first blank such that the pair of front panels form a portion of a face of the shelving unit. The first blank and the second blank are moveable between an erect position and a collapsed position. The plurality of support panels are operably configured to support the shelf panel when the shelving unit is in the erect position. The locking panel is operably configured to removably engage at least one of the plurality of support panels to retain the shelving unit in an erect position.

In yet another aspect, a method for forming a collapsible shelving unit is provided. The method includes providing a first blank including a rear panel, a pair of side panels, and a pair of front panels. Each of the pair of side panels extend from a side edge of the rear panel and include a fold line extending longitudinally along each of the side panels. Each of the pair of front panels extends from a side edge of a corresponding side panel. The method also includes providing at least one second blank including a shelf panel, a plurality of support panels, and a locking panel. The shelf panel includes a fold line that extends a width of the shelf panel. The plurality of support panels are coupled to the shelf panel. The method also includes coupling the at least one second blank to the first blank to form the collapsible shelving unit by extending the second blank in a width direction between the pair of side panels of the first blank, and extending the second blank in a depth direction between the rear panel and the front panels of the first blank such that the pair of front panels form a portion of a face of the shelving unit. The shelving unit is moveable between an erect position and a collapsed position. The plurality of support panels are operably configured to support the shelf panel when the shelving unit is in the erect position. The locking panel is operably configured to removably engage at least one of the plurality of support panels to retain the shelving unit in an erect position.

DETAILED DESCRIPTION OF THE INVENTION

Figure 1:
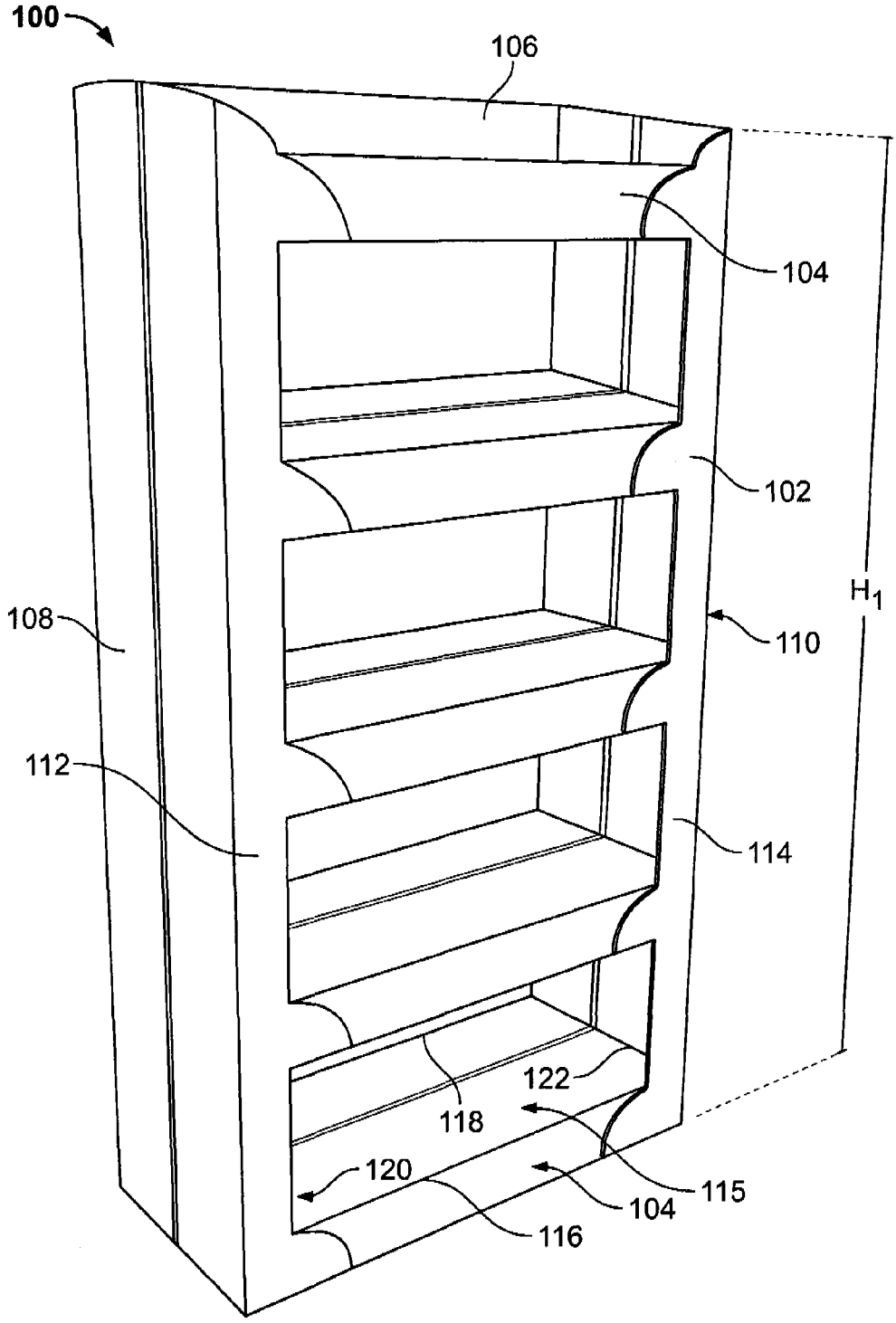
FIG. 1 is a perspective view of an exemplary multi-shelf paperboard display unit.

FIG. 1 is a perspective view of an exemplary multi-shelf paperboard display unit 100, also referred to as a collapsible shelving unit. Display unit 100 includes a base 102 having a plurality of shelves 104 coupled thereto. Base 102 includes a rear panel 106 that extends between a first side panel 108 and a second side panel 110. In the example embodiment and when unit 100 is in an erected position, first side panel 108 and second side panel 110 are substantially parallel with one another, and rear panel 106 is substantially perpendicular to both first side panel 108 and second side panel 110.

In the example embodiment, first side panel 108 is connected to a first front panel 112 along a fold line, and second side panel 110 is connected to a second front panel 114 along a fold line. Front panels 112 and 114 are substantially parallel to rear panel 106.

Each shelf 104 includes a shelf panel 115 having a front edge 116, a rear edge 118, a first side edge 120, and a second side edge 122. Shelves 104 are coupled to base 102 such that opposing ends of front edge 116 are adjacent front panels 112 and 114, rear edge 118 is adjacent rear panel 106, first side edge 120 is adjacent first side panel 108, and second side edge 122 is adjacent second side panel 110. In the exemplary embodiment, shelves 104 are positioned substantially equally along a height $H_1$ of base 102. In an alternative embodiment, shelves 104 are spaced unequally along height $H_1$. Further, the exemplary embodiment illustrates five shelves 104; however, alternative embodiments may include any suitable number of shelves 104. Moreover, in the exemplary embodiment, shelves 104 are coupled to base 102 with glue, however, in an alternative embodiment, shelves 104 may be coupled to base 102 using any suitable coupling mechanism. In addition, in the exemplary embodiment, both base 102 and shelves 104 are fabricated from paperboard, however, in an alternative embodiment, both base 102 and shelves 104 are fabricated from any suitable material capable of being assembled as described below, such as, but not limited to, cardboard, plastic, and corrugated paperboard.

Figure 2:
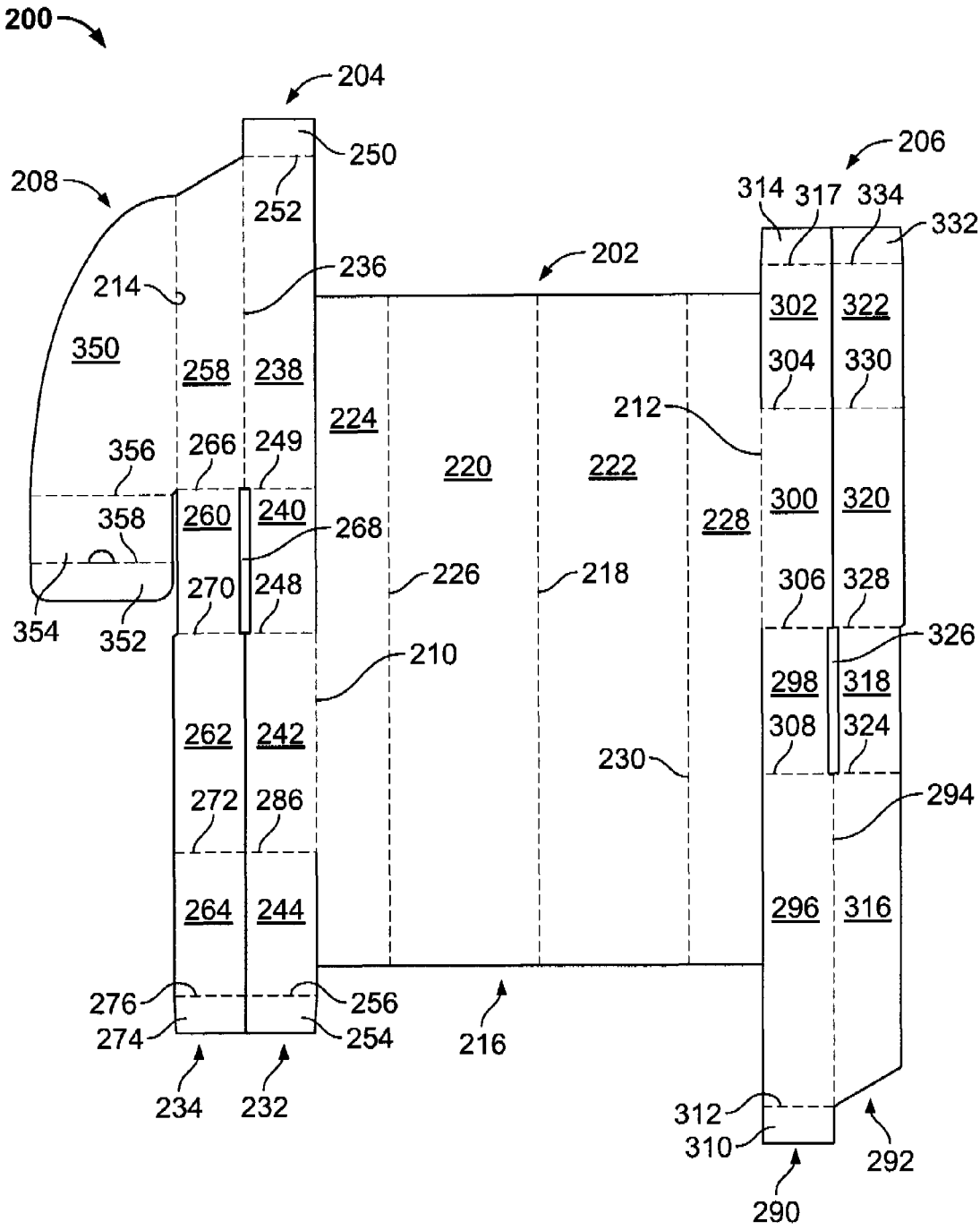
FIG. 2 is a top view of a blank that is used to assemble a shelf shown in FIG. 1.

FIG. 2 is a top view of a blank 200 used to assemble a shelf 104 (shown in FIG. 1). Blank 200 includes a base panel 202, a first support member 204, a second support member 206, and a locking member 208. First support member 204 is coupled to base panel 202 along a fold line 210, and second support member 206 is coupled to base panel 202 along a fold line 212. Further, locking member 208 is coupled to first support member 204 along a fold line 214.

Components shown in prior figures that are the same as shown in subsequent figures use the same reference numbers.

Base panel 202 includes a shelf panel 216 that is divided by a fold line 218 into a first central panel 220 and a second central panel 222. First central panel 220 is foldably connected to a first side panel 224 along a fold line 226, and second central panel 222 is foldably connected to a second side panel 228 along a fold line 230. First side panel 224 is foldably coupled along fold line 210 to first support member 204, and second side panel 228 is foldably coupled along fold line 212 to second support member 206.

First support member 204 includes an inner support member 232 and an outer support member 234 that is coupled to inner support member 232 along a fold line 236. Inner support member 232 is also foldably coupled along fold line 210 to first side panel 224. Inner support member 232 includes a first support panel 238, a second support panel 240, a third support panel 242, and a fourth support panel 244. Specifically, third support panel 242 is foldably coupled along fold line 210 to first side panel 224. Further, fourth support panel 244 and second support panel 240 are foldably coupled to third support panel 242 along fold lines 246 and 248, respectively, and first support panel 238 is foldably coupled to second support panel 240 along a fold line 249. A first attachment tab 250 is foldably coupled to first support panel 238 along a fold line 252, and a second attachment tab 254 is foldably coupled along a fold line 256 to fourth support panel 244.

Outer support member 234 includes a first support panel 258, a second support panel 260, a third support panel 262, and a fourth support panel 264. First support panel 258 is adjacent to, and foldably coupled along fold line 236 to, first support panel 238 of inner support member 232. Second support panel 260 is foldably coupled to first support panel 258 along a fold line 266, such that second support panel 260 is parallel to, and separated by a gap 268 from, second support panel 240 of inner support member 232. Third support panel 262 is foldably coupled to second support panel 260 along a fold line 270, such that third support panel 262 is positioned adjacent third support panel 242 of inner support member 232. Further, fourth support panel 264 is coupled to third support panel 262 along a fold line 272, such that fourth support panel 264 is positioned adjacent to fourth support panel 244 of inner support member 232. In addition, an attachment tab 274 is foldably coupled to fourth support panel 264 along a fold line 276, such that attachment tab 274 is positioned adjacent attachment tab 254.

Second support member 206 includes an inner support member 290 and an outer support member 292 that is coupled to inner support member 290 along a fold line 294. Inner support member 290 is also foldably coupled along fold line 212 to second side panel 228. Inner support member 290 includes a first support panel 296, a second support panel 298, a third support panel 300, and a fourth support panel 302. Specifically, third support panel 300 is foldably coupled along fold line 212 to second side panel 228. Further, fourth support panel 302 and second support panel 298 are foldably coupled to third support panel 300 along fold lines 304 and 306, respectively, and first support panel 296 is foldably coupled to second support panel 298 along a fold line 308. A first attachment tab 310 is foldably coupled to first support panel 296 along a fold line 312, and a second attachment tab 314 is foldably coupled along a fold line 317 to fourth support panel 302.

Outer support member 292 includes a first support panel 316, a second support panel 318, a third support panel 320, and a fourth support panel 322. First support panel 316 is adjacent to, and foldably coupled along fold line 294 to, first support panel 296 of inner support member 290. Second support panel 318 is foldably coupled to first support panel 316 along a fold line 324, such that second support panel 318 is parallel to, and separated by a gap 326 from, second support panel 298 of inner support member 290. Third support panel 320 is foldably coupled to second support panel 318 along a fold line 328, such that third support panel 320 is positioned adjacent third support panel 300 of inner support member 290. Further, fourth support panel 322 is coupled to third support panel 320 along a fold line 330, such that fourth support panel 322 is positioned adjacent to fourth support panel 302 of inner support member 290. In addition, an attachment tab 332 is foldably coupled to fourth support panel 322 along a fold line 334, such that attachment tab 332 is positioned adjacent attachment tab 314.

Locking member 208 includes a base panel 350, a locking tab 352 and central panel 354 extending therebetween. Locking member 208 is foldably coupled to first support member 204 along fold line 214. More specifically, base panel 350 is foldaby coupled along fold line 214 to first support panel 258 of outer support member 234. Central panel 354 is foldably coupled along a fold line 356 to base panel 350. Moreover, locking tab 352 is foldably coupled along a fold line 358 to central panel 354.

Figure 3:
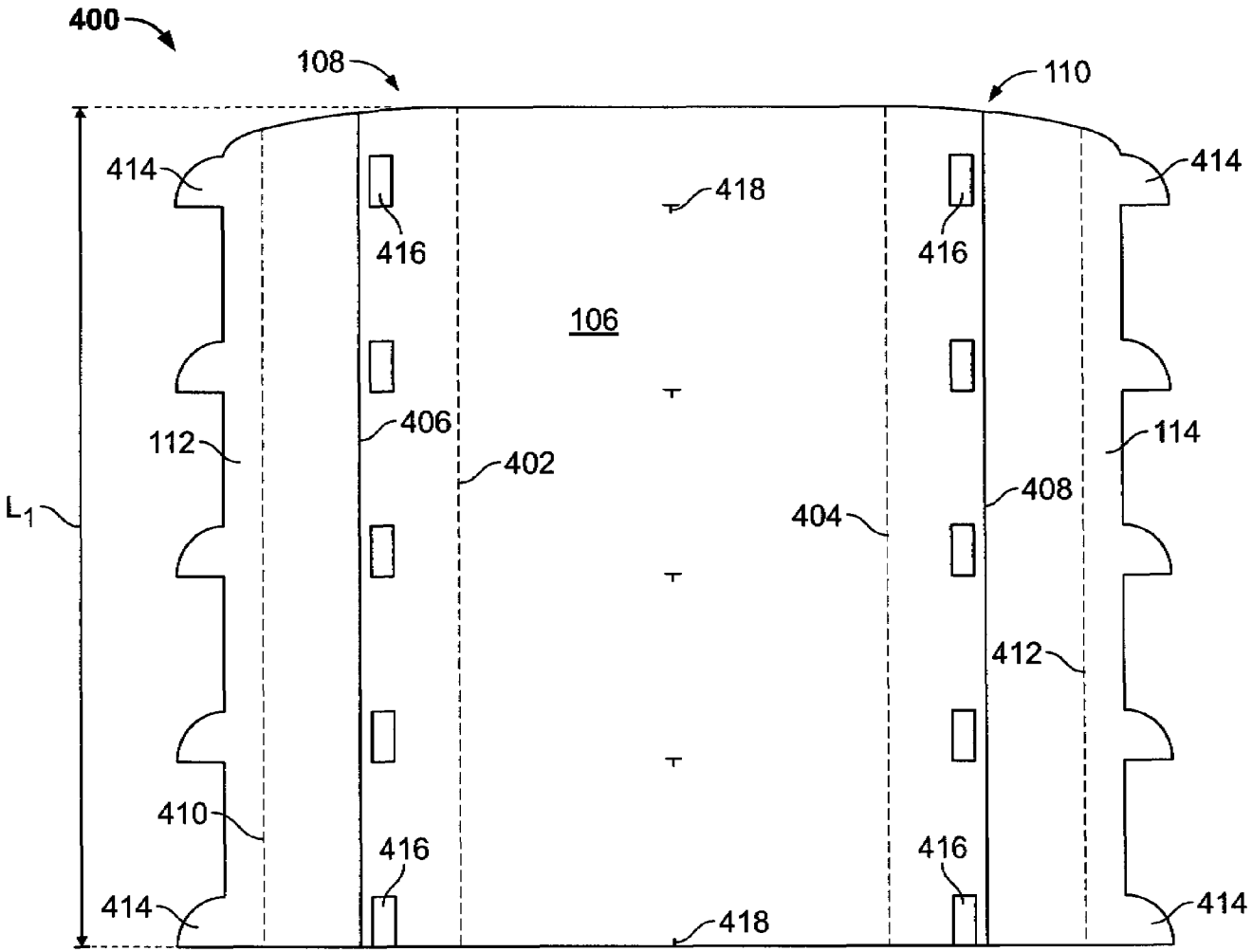
FIG. 3 is a top view of a blank that is used to assemble the base shown in FIG. 1.

FIG. 3 is a top view of a blank 400 used to assemble base 102. Blank 400 has a length $L_1$ that is substantially equal to display unit height $H_1$. Blank 400 includes base rear panel 106, base first side panel 108, base second side panel 110, and base front panels 112 and 114. Specifically, first side panel 108 and second side panel 110 are foldably coupled to rear panel 106 along fold lines 402 and 404, respectively. First side panel 108 includes a central fold line 406 extending length $L_1$, and second panel 110 likewise includes a central fold line 408 extending length $L_1$. Front panel 112 is foldably coupled along fold line 410 to first side panel 108, and front panel 114 is foldably coupled along fold line 412 to second side panel 110.

Each front panel 112 and 114 includes a plurality of tabs 414 extending therefrom. Each tab 414 is configured to couple to a front face of a shelf 104, as defined by second side panel 228 of a blank 200. Further, first side panel 108 and second side panel 110 each include a plurality of attachment locations 416 where a shelf 104 is configured to be coupled. In the exemplary embodiment, shelves 104 are glued to blank 400 at attachment locations 416. Moreover, rear panel 106 includes a plurality of attachment locations 418 that are aligned with attachment locations 416. In the exemplary embodiment, a rear face of a shelf 104, as defined by first side panel 224 of a blank 200 is configured to be glued to one of attachment locations 418.

Figure 4A:
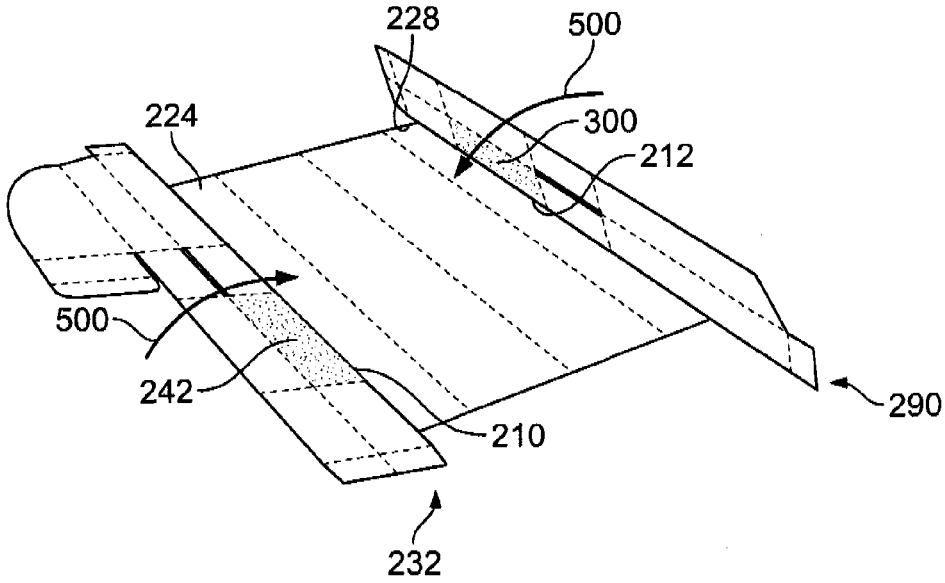
FIGS. 4*a*-4*f* illustrate the assembly of the display unit shown in FIG. 1 from the blanks shown in FIGS. 2 and 3.
Figure 4B:
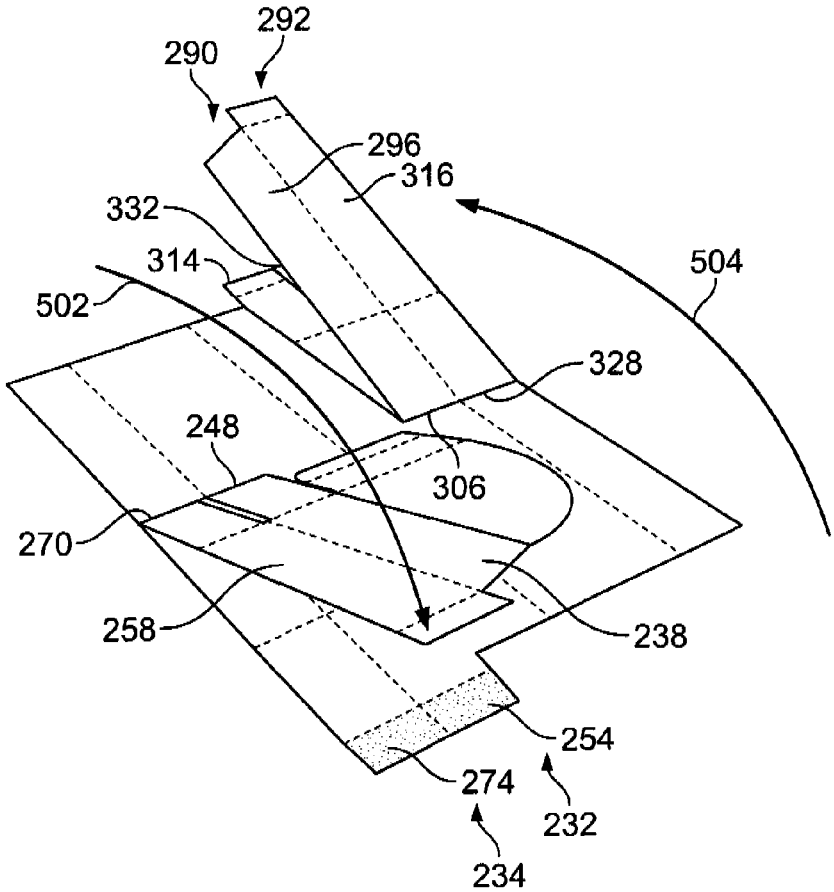
Figure 4C:
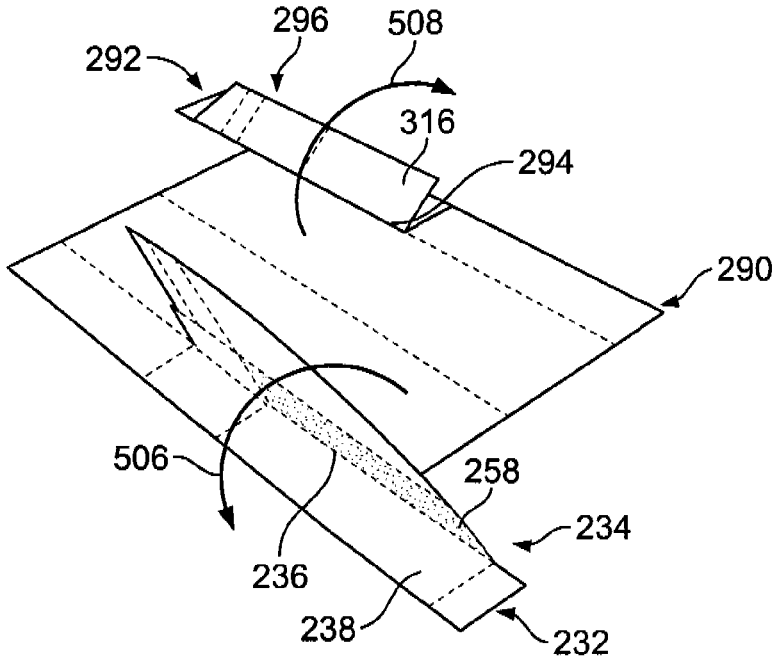
Figure 4D:
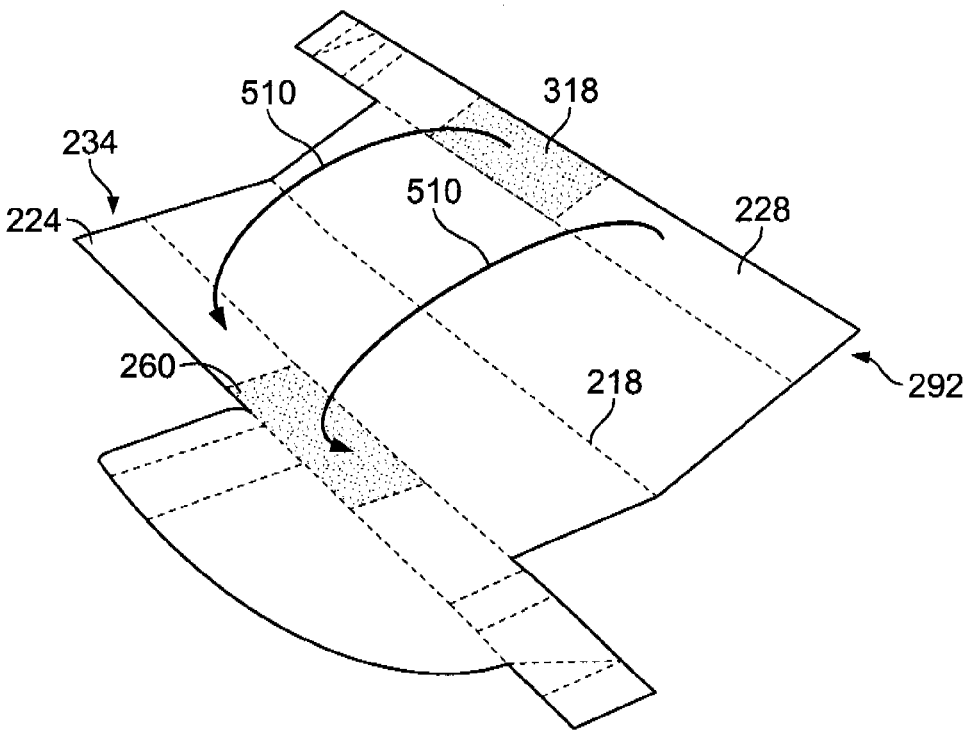
Figure 4E:
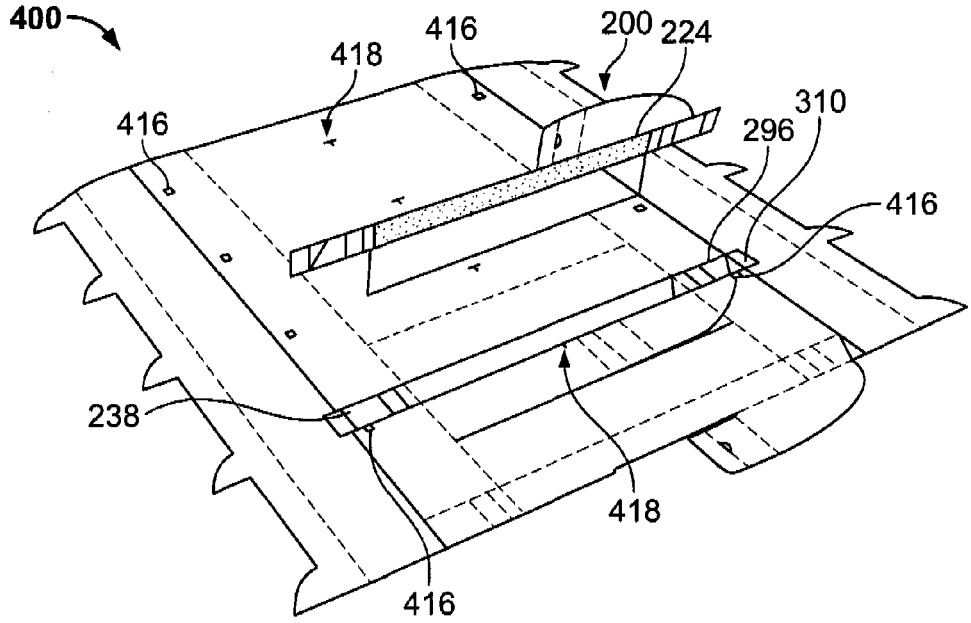
Figure 4F:
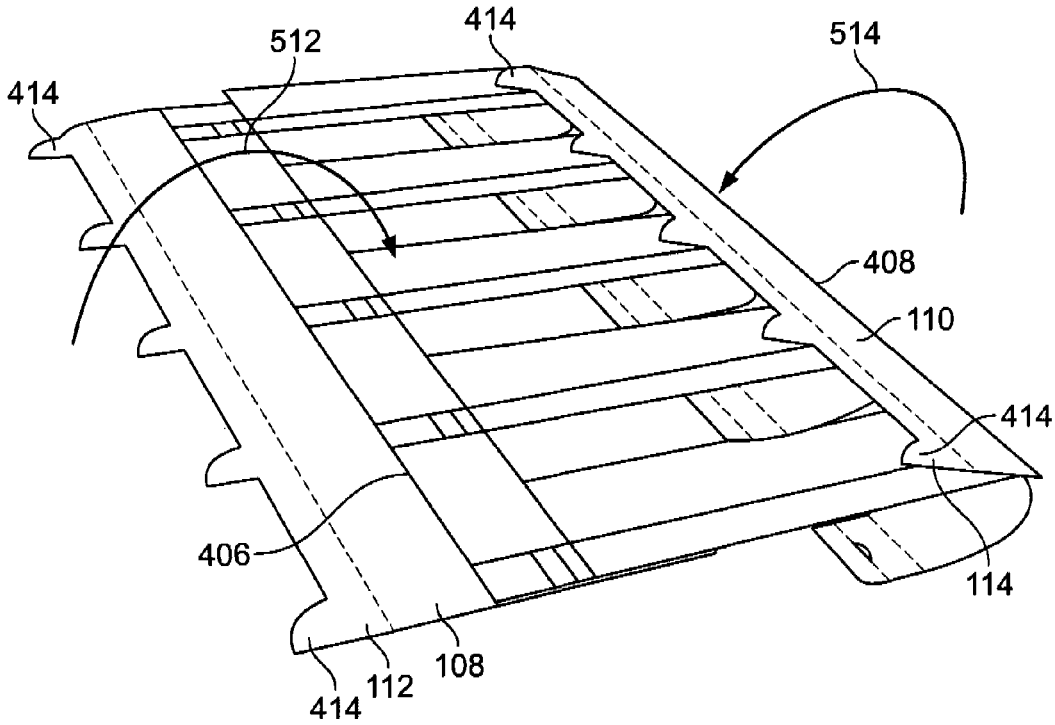

FIGS. 4*a*-4*f* illustrate the assembly of display unit 100 from blank 200 and blank 400. Specifically, FIGS. 4*a*-4*d* illustrate the assembly of a shelf 104 from blank 200 and FIGS. 4*e* and 4*f* illustrate attachment of shelf 104 to base 102. In FIGS. 4*a*-4*f*, glue is applied, as described below, to the shaded portions of blanks 200 and 400. In a first step, illustrated in FIG. 4*a*, glue is applied to third support panel 242 of inner support member 232 and third support panel 300 of inner support member 290. Blank 200 is then folded in along fold lines 210 and 212, in the direction of arrows 500, such that first support member 204 and second support member 206 are positioned adjacent base panel 202 in a substantially overlapping relationship. Specifically, third support panel 242 is secured to first side panel 224 in a substantially overlapping relationship, and third support panel 300 is secured to second side panel 228 in a substantially overlapping relationship.

In a second step, illustrated by FIG. 4*b*, glue is applied to attachment tabs 254 and 274. Blank 200 is then folded along fold lines 248 and 270, in the direction of arrow 502, such that attachment tab 254 is secured to first support panel 238 of inner support member 232 in a substantially overlapping relationship and attachment tab 274 is secured to first support panel 258 of outer support member 234 in a substantially overlapping relationship. Likewise, glue is also applied to attachment tabs 314 and 332, and blank 200 is folded along fold lines 306 and 328, in the direction of arrow 504, such that attachment tab 314 is secured to first support panel 296 of inner support member 290 in a substantially overlapping relationship and attachment tab 332 is secured to first support panel 316 of outer support member 292 in a substantially overlapping relationship.

In a third step, illustrated by FIG. 4*c*, glue is applied to both first support panel 258 and first support panel 316 of outer support member 234 and outer support member 292, respectively. Blank 200 is then folded along fold line 236, in the direction of arrow 506, such that first support panel 258 is secured to first support panel 238 of inner support member 232 in a substantially overlapping relationship. Likewise, blank 200 is folded along fold line 294, in the direction of arrow 508, such that first support panel 316 is secured to first support panel 296 of inner support member 290 in a substantially overlapping relationship.

In a fourth step, illustrated by FIG. 4*d*, glue is applied to second support panel 260 and second support panel 318 of outer support member 234 and outer support member 292, respectively. Blank 200 is then folded along fold line 218, in the direction of arrows 510, such that second support panel 260 is secured to second side panel 228 in a substantially overlapping relationship, and second support panel 318 is secured to first side panel 224 in a substantially overlapping relationship.

In a fifth step, illustrated by FIG. 4*e*, blank 200 is secured to blank 400. Specifically glue is applied to first side panel 224 of blank 200, and first side panel 224 is aligned with one of attachment locations 418, such that first support panel 238 and first support panel 296 are each aligned with a corresponding attachment location 416. First side panel 224 is then secured to rear panel 106 at attachment location 418, such that second side panel 228 faces upward. Glue is then applied to attachment tab 250, which is folded under first support panel 238 and secured to first side panel 108 at attachment location 416. Likewise glue is applied to attachment tab 310, which is folded under first support panel 296 and secured to second side panel 110 at attachment location 416. The fifth step is repeated for each blank 200, or shelf 104, being secured within base 102. As illustrated in FIG. 4*f*, the exemplary embodiment of display unit 100 includes five shelves 104, however, in an alternative embodiment, display unit 100 includes any suitable number of shelves 104.

In a sixth step, illustrated by FIG. 4*f*, blank 200 is further secured to blank 400. Specifically, glue is applied to each tab 414 of blank 400. Glue is also applied to portions of front panels 112 and 114 that are aligned with each tab 414. First side panel 108 is then folded along fold line 406, in the direction of arrow 512, such that front panel 112 and the tabs 414 coupled to front panel 112 are secured to second side panel 228 of each blank 200. Likewise, second side panel 110 is then folded along fold line 408, in the direction of arrow 514, such that front panel 114 and the tabs 414 coupled to front panel 114 are secured to second side panel 228 of each blank 200. Accordingly a collapsed display unit shelf 104 is formed. In the collapsed configuration, shelf panel 216 is folded along 218 such that first central panel 220 and second central panel 220 are positioned in a substantially overlapping relationship. Further, in the collapsed configuration, at least one of the individual support members of support member 204 and/or support member 206 is positioned in a substantially overlapping relationship with a second support member of support member 204 and/or support member 206. Moreover, in the collapsed configuration, side panels 108 and 110 are each folded along their respective fold lines 406 and 408 such that a first section of each side panel 108 and 110 is positioned in a substantially overlapping relationship with a second section of side panel 108 and 110.

Figure 5A:
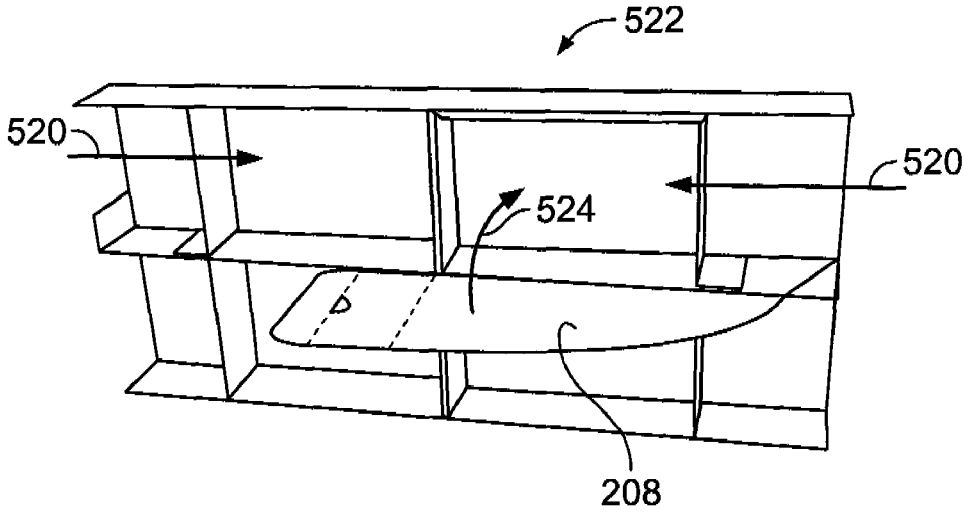
FIGS. 5*a* and 5*b* illustrate the method used to erect a display unit shelf shown in FIG. 1 from the blank shown in FIG. 2.
Figure 5B:
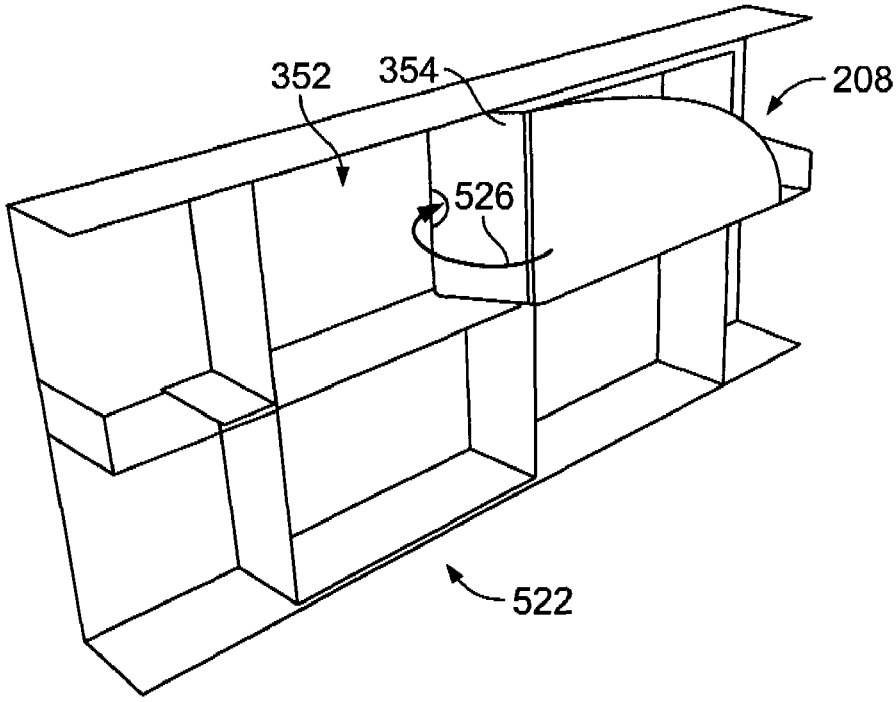

FIGS. 5*a* and 5*b* illustrate the method used to erect display unit shelf 104 shown in FIG. 1 from blank 200 shown in FIG. 2. In a first step, as illustrated by FIG. 5*a*, each shelf 104 of display unit 100 is formed by applying force, in the direction of arrows 520 to first side panel 108 (not shown) and second side panel 110 (not shown). The applied forces cause sides 108 and 110 to straighten at fold lines 406 and 408 (not shown), respectively, such that the support panels of each shelf 104 form a truss 522 that secures and stabilizes shelf panel 115. Locking member 208 extends downward from shelf 104 and is folded, in the direction of arrow 524, such that locking member 208 is positioned adjacent grid 522. FIG. 5*b* illustrates how locking member 208 is used to secure shelf 104. Specifically, central panel 354 and locking tab 352 of locking member 208 are folded downward, in the direction of arrow 526 such that central panel 354 is positioned adjacent a portion of truss 522. Locking tab 352 is then positioned under a portion of truss 522. When each shelf 104 is secured by locking mechanism 280, a display unit as illustrated in FIG. 1 is fully erected.

Accordingly, the present invention provides a collapsible shelving unit made from a foldable material. The shelving unit includes a base member including a rear panel, a pair of side panels, and a pair of front panels. Each of the pair of side panels extend from a side edge of the rear panel and include a fold line that extends longitudinally along each of the side panels. Each of the pair of front panels extend from a side edge of a corresponding side panel to form a portion of a face of the shelving unit. The shelving unit also includes at least one shelf member coupled to the base member. The shelf member extends in a width direction between the pair of side panels and extends in a depth direction between the rear panel and the front panels. The shelf member includes a shelf panel, a plurality of support panels, and a locking panel. The shelf panel includes a fold line extending a width of the shelf panel. The plurality of support panels are coupled to the shelf panel and configured to support the shelf panel. The base member and the at least one shelf member are moveable between an erect position and a collapsed position. The locking panel is operably configured to removably engage at least one of the plurality of support panels to retain the shelving unit in an erect position.

In the exemplary embodiment, the fold line extending the width of the shelf panel divides the shelf panel into a first section and a second section. The shelf panel is pivotable along the shelf panel fold line such that that the first section of the shelf panel substantially overlaps the second section of the shelf panel when the shelving unit is in the collapsed position. Further, the fold line extending longitudinally along each side panel extends along a center of the side panel and divides the side panel into a first section and a second section. Each side panel is pivotable along the side panel fold line such that the first section of each side panel substantially overlaps the second section of the side panel when the shelving unit is in the collapsed position. Moreover, the face of the shelving unit is movable toward the rear panel such that the shelving unit is collapsible into a substantially flat configuration when in the collapsed position.

Also in the exemplary embodiment, each front panel of the base member comprises a tab coupled to a portion of the shelf panel of the at least one shelf member. Further, the at least one shelf member includes at least one tab coupled to each side panel of the base member. Moreover, the shelf panel comprises at least one front panel that forms a portion of the face of the shelving unit. In addition, the shelf panel comprises at least one rear panel coupled to the rear panel of the base member.

In the exemplary embodiment, the plurality of support panels comprise a first set of support panels extending in the width direction and a second set of support panels extending in the depth direction to form a support structure. Further, the locking member is coupled to at least one of the first set of support panels and is configured to removably engage at least one of the second set of support panels to retain the shelving unit in the erect position. Moreover, each of the plurality of support panels overlaps at least one other support panel when the shelving unit is in the collapsed position. In addition, the locking panel comprises a tab configured to removably engage at least one of the plurality of support panels. Furthermore, the base member comprises at least one attachment location where the at least one shelf member couples to the base member.

Also in the exemplary embodiment, the collapsible shelving unit includes a plurality of shelf members coupled to the base member. Further, the base member and the at least one shelf member are fabricated from at least one of paperboard, cardboard, plastic, and corrugated paperboard.

The present invention also provides a pair of blanks for forming a collapsible shelving unit. The blanks are formed from a foldable sheet material. The pair of blanks include a first blank including a rear panel, a pair of side panels, and a pair of front panels. Each of the pair of side panels extend from a side edge of the rear panel and include a fold line extending longitudinally along each of the side panels. Each of the pair of front panels extending from a side edge of a corresponding side panel. The pair of blanks also includes a second blank including a shelf panel, a plurality of support panels, and a locking panel. The shelf panel includes a fold line that extends a width of the shelf panel. The plurality of support panels are coupled to the shelf panel. At least one second blank is configured to couple to the first blank to form the collapsible shelving unit. The second blank extends in a width direction between the pair of side panels of the first blank and extends in a depth direction between the rear panel and the front panels of the first blank when the second blank is coupled to the first blank such that the pair of front panels form a portion of a face of the shelving unit. The first blank and the second blank are moveable between an erect position and a collapsed position. The plurality of support panels are operably configured to support the shelf panel when the shelving unit is in the erect position. The locking panel is operably configured to removably engage at least one of the plurality of support panels to retain the shelving unit in an erect position.

The present invention further provides a method for forming a collapsible shelving unit. The method includes providing a first blank including a rear panel, a pair of side panels, and a pair of front panels. Each of the pair of side panels extend from a side edge of the rear panel and include a fold line extending longitudinally along each of the side panels. Each of the pair of front panels extend from a side edge of a corresponding side panel. The method also includes providing at least one second blank including a shelf panel, a plurality of support panels, and a locking panel. The shelf panel includes a fold line that extends a width of the shelf panel. The plurality of support panels are coupled to the shelf panel. The method also includes coupling the at least one second blank to the first blank to form the collapsible shelving unit by extending the second blank in a width direction between the pair of side panels of the first blank, and extending the second blank in a depth direction between the rear panel and the front panels of the first blank such that the pair of front panels form a portion of a face of the shelving unit. The shelving unit is moveable between an erect position and a collapsed position. The plurality of support panels are operably configured to support the shelf panel when the shelving unit is in the erect position. The locking panel is operably configured to removably engage at least one of the plurality of support panels to retain the shelving unit in an erect position.

In one embodiment, a multi-shelf paperboard display unit is provided. The display unit includes a base having a rear panel, two opposed side panels, and two front support flaps. The two opposed side panels extend substantially perpendicularly from the rear panel, and each of the two front support flaps extend substantially perpendicularly from one of the opposed side panels such that the two front support flaps are substantially parallel to the rear panel. The display unit also includes a plurality of shelves, each formed from a unitary blank, and coupled to the base. Each shelf includes a base panel, two support members extending from opposed ends of the base panel, and a locking mechanism. Each support member includes a plurality of support panels configured to form a truss to support the base panel, wherein the truss includes a plurality of rectangular members formed from the plurality of support panels. The locking mechanism is configured to secure the truss to help prevent failure of the shelf. The base and shelves are coupled together in a collapsed configuration such that the display unit can be manipulated between the collapsed and an erected configuration.

In another embodiment, a method of assembling a multi-shelf paperboard display unit is provided. The method includes providing a base having a rear panel, two opposed side panels, and two front support flaps. The method also includes extending the two opposed side panels substantially perpendicularly from side rear panel, and extending each of the two front support flaps substantially perpendicularly from one of the opposed side panels such that the two front support flaps are substantially parallel to the rear panel. The method also includes coupling a plurality of shelves, each formed from a unitary blank, to the base. Each shelf includes a base panel, two support members extending from opposed ends of the base panel, and a locking mechanism. The method also includes configuring the plurality of support panels to form a truss to support the base panel, wherein the truss comprising a plurality of rectangular members formed from the plurality of support panels. The method also includes securing the truss with the locking mechanism to prevent failure of the shelf. The method also includes coupling the base and shelves together in a collapsed configuration such that the display unit can be manipulated between the collapsed and an erected configuration.

The above described method and apparatus provides an inexpensive and secure display unit for use in the merchandise industry or any other industry. Specifically, the above-described method and apparatus provide a unitary shelving unit that is easily collapsed and assembled by merely folding portions of the unit. Further, the display unit provides added support and strength due the central and side struts that are easily formed from a unitary blank. Such added strength and support eliminates the need for metal or wooden poles and/or plastic support pieces that are commonly required by collapsible shelving units. As such, the display unit is fabricated entirely from paperboard and, therefore, is also easily recyclable.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the apparatus and methods described herein are described in the context of a multi-shelf display unit, it is understood that the apparatus and methods are not limited to multi-shelf display units. Likewise, the display unit components illustrated are not limited to the specific embodiments described herein, but rather, components of the display unit can be utilized independently and separately from other components described herein.

While the invention has been described in terms of various specific embodiments, those skilled in the art will recognize that the invention can be practiced with modification within the spirit and scope of the claims.

What is claimed is:

1. A collapsible shelving unit made from a foldable material, the shelving unit comprising:

a base member comprising a rear panel, a pair of side panels, and a pair of front panels, each of the pair of side panels extending from a side edge of the rear panel and including a fold line extending longitudinally along each of the side panels, each of the pair of front panels extending from a side edge of a corresponding side panel to form a portion of a face of the shelving unit; and at least one shelf member coupled to the base member, the at least one shelf member extending in a width direction between the pair of side panels and extending in a depth direction between the rear panel and the front panels, the shelf member comprising a shelf panel, a pair of side panels each extending from a front or rear edge of the shelf panel, a plurality of support panels, and a locking member, the shelf panel including a fold line extending a width of the shelf panel and spaced between the pair of side panels, the plurality of support panels coupled to the shelf panel and configured to support the shelf panel, wherein the base member and the at least one shelf member are moveable between an erect position and a collapsed position, the shelf panel of the at least one shelf member substantially perpendicular to the rear panel of the base member in the erect position and the shelf panel substantially parallel to the rear panel of the base member in the collapsed position, the at least one shelf member remaining coupled to the base member as the base member and the at least one shelf member move between the erect position and the collapsed position, and wherein the locking member is operably configured to removably engage at least one of the plurality of support panels to retain the shelving unit in the erect position.

2. A collapsible shelving unit in accordance with claim 1 wherein the fold line extending the width of the shelf panel divides the shelf panel into a first section and a second section, the shelf panel is pivotable along the shelf panel fold line such that that the first section of the shelf panel substantially overlaps the second section of the shelf panel when the shelving unit is in the collapsed position.

3. A collapsible shelving unit in accordance with claim 1 wherein the fold line extending longitudinally along each side panel extends along a center of the side panel and divides the side panel into a first section and a second section, wherein each side panel is pivotable along the side panel fold line such that the first section of each side panel substantially overlaps the second section of the side panel when the shelving unit is in the collapsed position.

4. A collapsible shelving unit in accordance with claim 1 wherein the face of the shelving unit is movable toward the rear panel such that the shelving unit is collapsible into a substantially flat configuration when in the collapsed position.

5. A collapsible shelving unit in accordance with claim 1 wherein each front panel of the base member comprises a tab coupled to a portion of the shelf panel of the at least one shelf member.

6. A collapsible shelving unit in accordance with claim 1 wherein the at least one shelf member includes at least one tab coupled to each side panel of the base member.

7. A collapsible shelving unit in accordance with claim 1 wherein the pair of side panels each extending from the front or rear edge of the shelf panel further comprises a front side panel extending from the front edge of the shelf panel and forming a portion of the face of the shelving unit.

8. A collapsible shelving unit in accordance with claim 1 wherein the pair of side panels each extending from the front or rear edge of the shelf panel further comprises a rear side panel extending from the rear edge of the shelf panel and coupled to the rear panel of the base member.

9. A collapsible shelving unit in accordance with claim 1 wherein the plurality of support panels comprise a first set of support panels extending in the width direction and a second set of support panels extending in the depth direction to form a support structure.

10. A collapsible shelving unit in accordance with claim 9 wherein the locking member is coupled to at least one of the first set of support panels and is configured to removably engage at least one of the second set of support panels to retain the shelving unit in the erect position.

11. A collapsible shelving unit in accordance with claim 1 wherein each of the plurality of support panels overlaps at least one other support panel when the shelving unit is in the collapsed position.

12. A collapsible shelving unit in accordance with claim 1 wherein the locking member comprises a tab configured to removably engage at least one of the plurality of support panels.

13. A collapsible shelving unit in accordance with claim 1 wherein the base member comprises at least one attachment location where the at least one shelf member couples to the base member.

14. A collapsible shelving unit in accordance with claim 1 further comprising a plurality of shelf members coupled to the base member.

15. A collapsible shelving unit in accordance with claim 1 wherein the base member and the at least one shelf member are fabricated from at least one of paperboard, cardboard, plastic, and corrugated paperboard.

* * * * *